US006057819A

United States Patent [19]

Sone et al.

[11] Patent Number: 6,057,819

[45] Date of Patent: May 2, 2000

[54] LIQUID CRYSTAL DISPLAY APPARATUS AND DRIVE CIRCUITRY USED IN THE SAME APPARATUS

[75] Inventors: Takehiko Sone; Takehiro Ishikawa, both of Fukushima-ken, Japan

[73] Assignee: Alps Electric Co., Ltd., Japan

[21] Appl. No.: 08/911,517

[22] Filed: Aug. 14, 1997

[30] Foreign Application Priority Data

Aug. 28, 1996 [JP] Japan ..... 8-227150

[51] Int. Cl.[7] ..... G09G 3/36

[52] U.S. Cl. ..... 345/96; 345/98; 327/108

[58] Field of Search ..... 345/89, 92, 98, 345/99, 50, 90, 96, 94, 212, 173; 327/108

[56] References Cited

U.S. PATENT DOCUMENTS

| | | | |
|---|---|---|---|
| 3,961,840 | 6/1976 | Morokawa et al. | 345/50 |
| 4,393,380 | 7/1983 | Hosokawa et al. | 345/90 |
| 4,734,692 | 3/1988 | Hosono et al. | 345/96 |
| 5,379,050 | 1/1995 | Annis et al. | 345/94 |
| 5,489,910 | 2/1996 | Kuwata et al. | 345/212 |
| 5,534,892 | 7/1996 | Tagawa | 345/173 |
| 5,635,865 | 6/1997 | Moon et al. | 327/108 |

*Primary Examiner*—Steven J. Saras
*Assistant Examiner*—Fritz Alphonse
*Attorney, Agent, or Firm*—Brinks Hofer Gilson & Lione

[57] ABSTRACT

A liquid crystal display apparatus is provided in which crosstalk (after-image extending from a line displayed on the screen) is eliminated. Drive circuitry used in the above type of apparatus is also provided. A delay circuit divides an alternating-current (AC) signal generated by an alternating-current (AC) signal circuit into two signals, i.e., a common AC signal (DF COM) and a segment AC signal (DF SEG). One signal is delayed later than the other. When the common AC signal is delayed later than the segment AC signal, white crosstalk (which is a white bar having a brightness level higher than a white background, appearing on the line extending from a narrow black bar displayed on the screen) is eliminated from the screen. On the other hand, when the segment AC signal is delayed later than the common AC signal, black crosstalk (which is a black bar having a brightness level slightly lower than a white background, emerging on the line extending from a thick black bar displayed on the screen) is removed from the screen. An integrating circuit or a delay line is employed as a delay function of the delay circuit.

1 Claim, 9 Drawing Sheets

LIQUID CRYSTAL DISPLAY APPARATUS AND DRIVE CIRCUITRY USED IN THE SAME APPARATUS

BACKGROUND OF THE INVENTION

1. Field of the Invention

The present invention relates to drive circuitry for driving a liquid crystal display panel (LCD panel) by applying a common voltage and a segment voltage to the LCD panel. The invention also pertains to a liquid crystal display apparatus provided with the above type of drive circuitry.

2. Description of the Related Art

FIG. 8 is a block diagram illustrating an example of conventional liquid crystal display apparatuses. In FIG. 8, voltages $V_1$ through $V_6$ generated by a bias power supply circuit 1 are inverted at a timing provided by an alternating-current (AC) signal circuit 2, and are applied to common electrodes and segment electrodes of an LCD panel 3.

FIG. 9 is a circuit diagram illustrating an example of the configuration of the bias power supply circuit 1. In FIG. 9, the resistances of the respective resistors $R_1$ through $R_5$ are determined, for example, as follows: the resistances of the resistors $R_1$, $R_2$, $R_4$, and $R_5$ are 1 [kΩ], while the resistance of the resistor $R_3$ is 11 [kΩ]. An amplifier 4 is provided to maintain the voltages $V_3$ through $V_6$ in the case of the generation of overcurrent. FIG. 9 shows that the bias power supply circuit 1 divides a power voltage $V_{EE}$ (for example, 30 [V]) supplied from an external source, such as a personal computer, so as to generate the voltages $V_1$ through $V_6$.

The voltages $V_1$ through $V_6$ shown in FIG. 9 can be calculated as follows.

$$V_1=30\ [V]$$

$$V_6=(30/15)\times 14=28\ [V]$$

$$V_3=(30/15)\times 13=26\ [V]$$

$$V_4=(30/15)\times 2=4\ [V]$$

$$V_5=(30/15)\times 1=2\ [V]$$

$$V_2=0\ [V]$$

The intermediate voltage (15[V]) between the power supply voltage $V_{EE}$ (30[V]) and the ground voltage (0[V]) is determined to be the center voltage. Then, the voltages $V_1$ and $V_2$, $V_3$ and $V_4$, and $V_5$ and $V_6$ are respectively symmetrical to each other relative to the center voltage. In other words, the voltage obtained by inverting the voltage $V_1$ is $V_2$, and similarly, the inverted voltages of $V_3$ and $V_5$ are $V_4$ and $V_6$, respectively.

FIG. 10 illustrates a wiring pattern of the common electrodes and the segment electrodes of the LCD panel 3. FIG. 10 represents that the LCD panel 3 is formed by wiring, for example, 480 common electrodes and 640 segment electrodes, in an orthogonal direction. Each intersection between a common electrode and a segment electrode designates one pixel of the LCD panel 3. With this arrangement, a voltage equal to an amount of (a voltage applied to a common electrode)—(a voltage applied to a segment electrode) is applied to a liquid crystal layer of each pixel.

The voltage applied to a common electrode (hereinafter referred to as "the common voltage") determines whether or not the pixels on the common electrode are to be selected, i.e., whether the pixels are in the "selective state" or the "non-selective state". In contrast, the voltage applied to a segment electrode (hereinafter referred to as "the segment voltage") determines the display status, i.e., the "on-state" or "off-state", of the pixels on the selected segment electrode.

More specifically, in order to switch on a certain pixel, as shown in FIG. 10, the voltage $V_1$ is applied to the corresponding common electrode so as to select the pixel, and also, the voltage $V_2$ is applied to the corresponding segment electrode. Accordingly, the voltage ($V_1-V_2=30$ [V]) is applied to the liquid crystal layer of the pixel positioned at the intersection between the designated common electrode and the segment electrode. The selected pixel is thus set to the on-state.

Conversely, in order to switch off a certain pixel, as illustrated in FIG. 10, the voltage $V_1$ is applied to the associated common electrode so as to select the pixels, while the voltage $V_4$ is applied to the corresponding segment electrode. Thus, the voltage ($V_1-V_4=26$ [V]) is applied to the liquid crystal layer of the pixel located at the intersection between the specified common electrode and the segment electrode. As a result, the selected pixel is set to the off-state. In the above operation, while the voltage $V_1$ is applied to the corresponding common electrode, the voltage $V_5$ is applied to the other common electrodes in order to render the pixels other than the selected pixel in the off-state.

FIG. 11 illustrates the waveforms of the common voltage and the segment voltage applied to a selected pixel during one frame. The term "one frame" indicates a frame during which all of the pixels forming one frame of a liquid crystal display apparatus are displayed either in the on-state or the off-state. Moreover, "one frame" consists of a duration during which a selected pixel is set to the on-state or the off-state (i.e., the selective duration) and a duration during which the other pixels are placed to the on-state or the off-state (i.e., non-selective duration). In FIG. 10, the horizontal axis represents time; it will now be assumed that the time axes of the upper and lower waveforms (the common voltage waveform and the segment voltage waveform) in FIG. 10 are consistent.

FIG. 11 reveals that the common voltage waveform alternates during the non-selective duration between an interval at which the voltage $V_5$ is applied (the interval A) and an interval during which the voltage $V_6$ is applied (the interval B). During the selective duration, the common voltage waveform exhibits a voltage to be applied to the common electrode corresponding to the selected pixel. In the example shown in FIG. 11, the voltage $V_1$ is applied during the interval A, while the voltage $V_2$ is applied during the interval B.

The segment voltage waveform shown in FIG. 11 alternates during one frame between an interval at which a negative voltage is used (the interval A), and an interval at which a positive voltage is used (the interval B). During the interval A, the pixels are switched on with the voltage $V_2$, while the pixels are switched off with the voltage $V_4$. In contrast, during the interval B, the pixels are switched on with the voltage $V_1$, while the pixels are switched off with the voltage $V_3$.

In this manner, the common voltage waveform and the segment voltage waveform are inverted at a fixed cycle (the interval A and the interval B) in order to preserve the quality of the liquid crystal layers of the pixels. Namely, the liquid crystal layers have the property of easily deteriorating if a voltage of the same polarity is continuously applied thereto. It is thus necessary that the polarities of the voltages applied to the liquid crystal layers be inverted at a fixed cycle (between the interval A and the interval B).

The signal having a fixed cycle is an AC signal (DF') output from the AC signal circuit 2 shown in FIG. 8.

Namely, the AC signal circuit 2 generates an AC signal (DF'), which is a rectangular wave signal inverting at a fixed cycle. Then, common drivers 5 and segment drivers 6 determine, based on the AC signal (DF'), the cycle of the common voltage and the segment voltage, i.e., the interval A or the interval B indicated in FIG. 11. In the liquid crystal display apparatus shown in FIG. 8, since the shared AC signal (DF') is supplied to the common drivers 5 and the segment drivers 6, the common voltage waveform and the segment voltage waveform are inverted at the same timing, as illustrated in FIG. 11.

FIG. 12 illustrates the waveform of the voltage applied to the liquid crystal layer of a selected pixel during one frame period. This waveform is obtained when the common voltage and the segment voltage indicated in FIG. 11 are applied to the selected pixel. FIG. 12 reveals that 2 [V] or −2 [V] is applied to the liquid crystal layer of the selected pixel during the non-selective duration.

As shown in FIG. 11, the voltage $V_1$ (or the voltage $V_2$) is applied to the common electrode during the selective duration, so that the selected pixel is displayed with a differential voltage between the common voltage and the segment voltage. In the example shown in FIG. 12, the designated pixel is displayed in the off-state with the voltage ($V_1-V_4$=26 [V]). If, however, it is desired that the designated pixel is switched on, the voltage ($V_1-V_2$=30 [V]) is applied thereto.

The following problems are, however, encountered by the above-described known liquid crystal display apparatus. When a narrow black bar is displayed in a white background on the screen of the LCD panel, a white bar having a brightness level higher than the white background (hereinafter referred to as "white crosstalk") disadvantageously appears on a line extending from the black bar. Moreover, when a thick black bar is displayed in a white background on the screen, a black bar having a brightness level slightly lower than the white background (hereinafter referred to as "black crosstalk") unfavorably emerges on a line extending from the black bar.

SUMMARY OF THE INVENTION

Accordingly, in view of the above background, it is an object of the present invention to provide a liquid crystal display apparatus which eliminates white crosstalk and black crosstalk on the screen, and also to provide drive circuitry used in the liquid crystal display apparatus of the above type.

In order to achieve the above object, according to the present invention, there is provided drive circuitry used in a liquid crystal display apparatus, the driving circuitry comprising an alternating-current-signal delay circuit including delay means, the delay circuit dividing an alternating-current signal generated in the liquid crystal display apparatus into two signals so as to delay one of the divided signals by the delay means, wherein either of the delayed signal or the undelayed signal is used as a common alternating-current signal, and the other signal is used as a segment alternating-current signal.

With this arrangement, the common voltage waveform and the segment voltage waveform are inverted at different timings. It is thus possible to eliminate white crosstalk and black crosstalk from the screen. White crosstalk is a type of a white bar having a brightness level higher than a white background, which is generated when a black bar is displayed in a white background on the line extending from the black bar. On the other hand, black crosstalk is a type of a black bar having a brightness level slightly lower than a white background, which is produced when a thick black bar is displayed in a white background on the line extending from the black bar.

The present inventor has found that the above-described crosstalk can be eliminated from the screen by dividing the AC signal (DF') shown in FIG. 8 into two signals, i.e., a common AC signal and a segment AC signal, and by delaying one of the signals later than the other for 0.1 to 1 [$\mu$s].

More specifically, in the present invention, when it is desired that white crosstalk be erased from the screen, the common AC signal is delayed later than the segment AC signal. Accordingly, the switching timing of the common voltage waveform (switching from the interval A to the interval B, and vice versa) is delayed later than that of the segment voltage waveform. As a consequence, white crosstalk can be removed from the screen. In contrast, for eliminating black crosstalk, the segment AC signal is delayed later than the common AC signal. This makes it possible to delay the switching timing of the segment voltage waveform later than that of the common voltage waveform, thereby eliminating black crosstalk from the screen.

DESCRIPTION OF THE PREFERRED EMBODIMENTS

Figure 1:
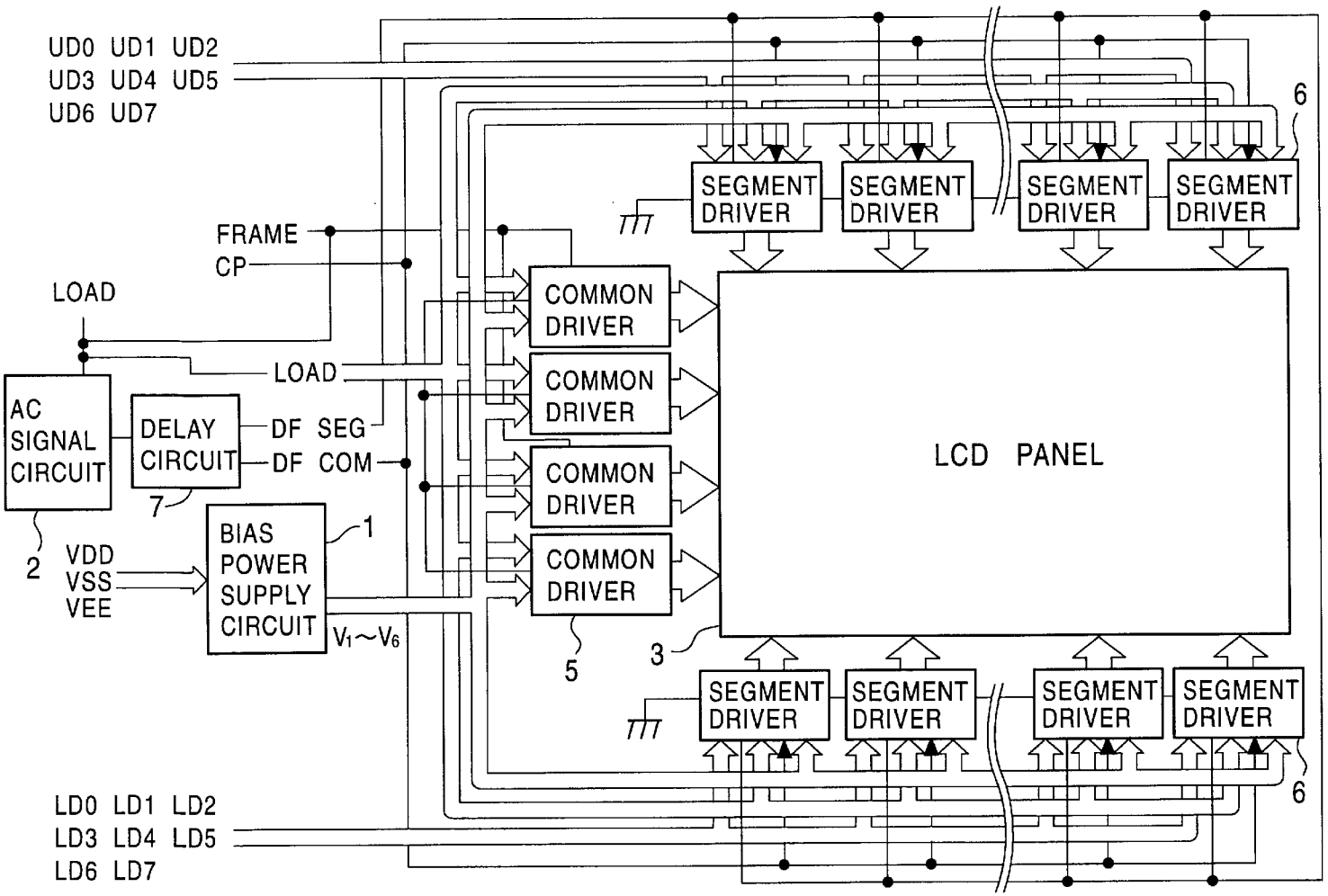
FIG. 1 is a block diagram of a liquid crystal display apparatus according to an embodiment of the present invention.
Figure 8:
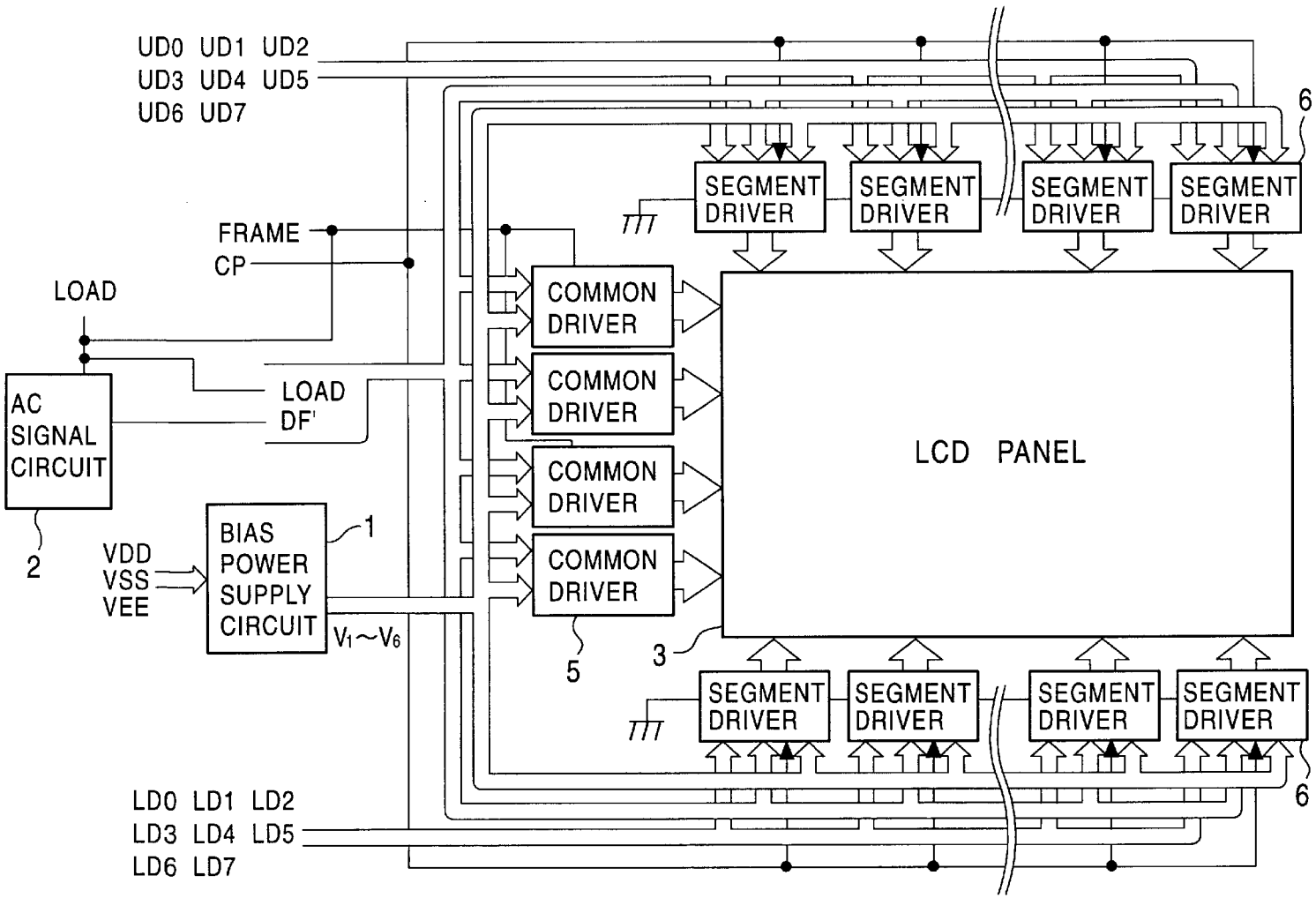
FIG. 8 is a block diagram illustrating an example of conventional liquid crystal display apparatuses.
Figure 9:
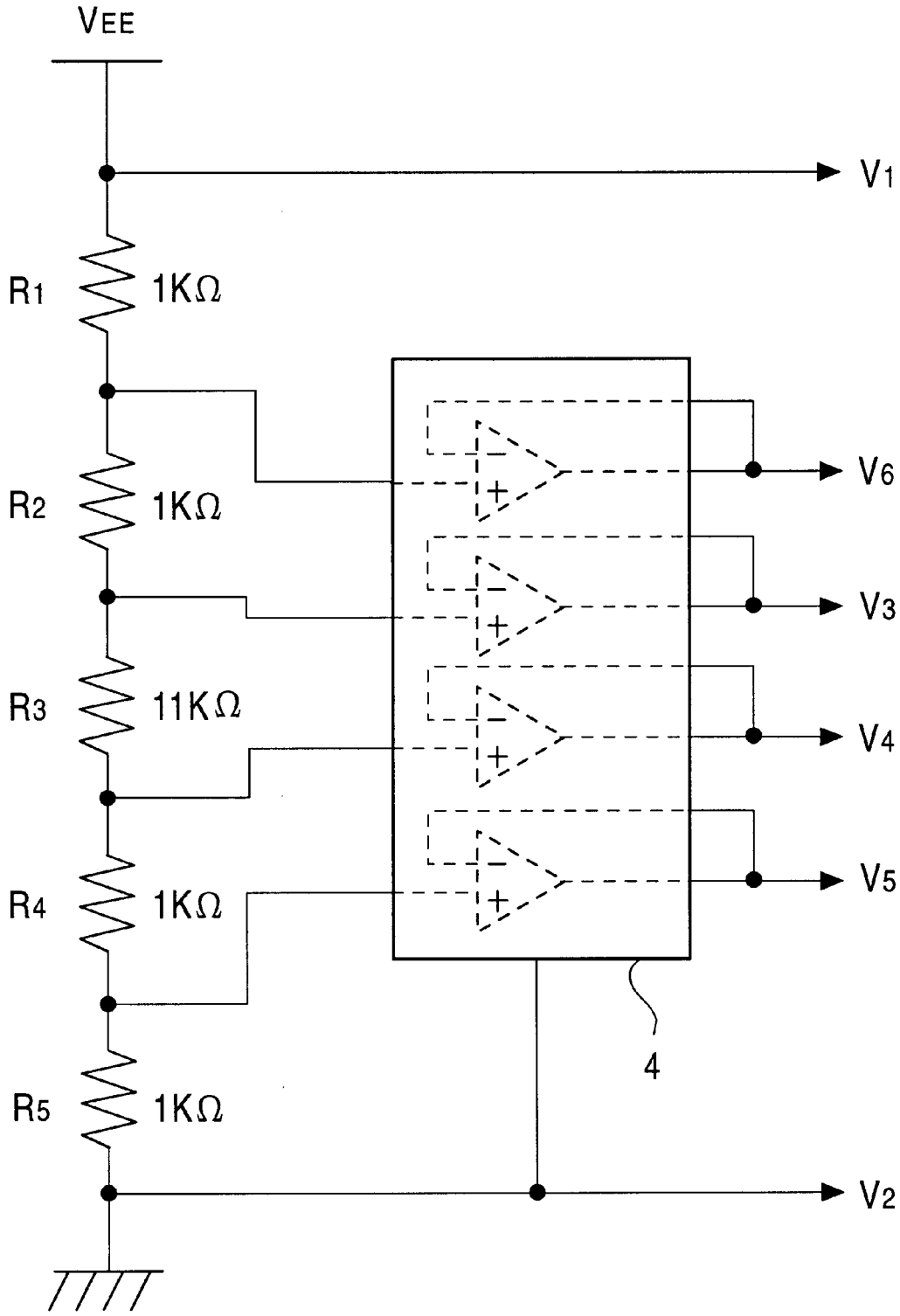
FIG. 9 is a circuit diagram illustrating an example of the configuration of the bias power supply circuit shown in FIG. 8.
Figure 10:
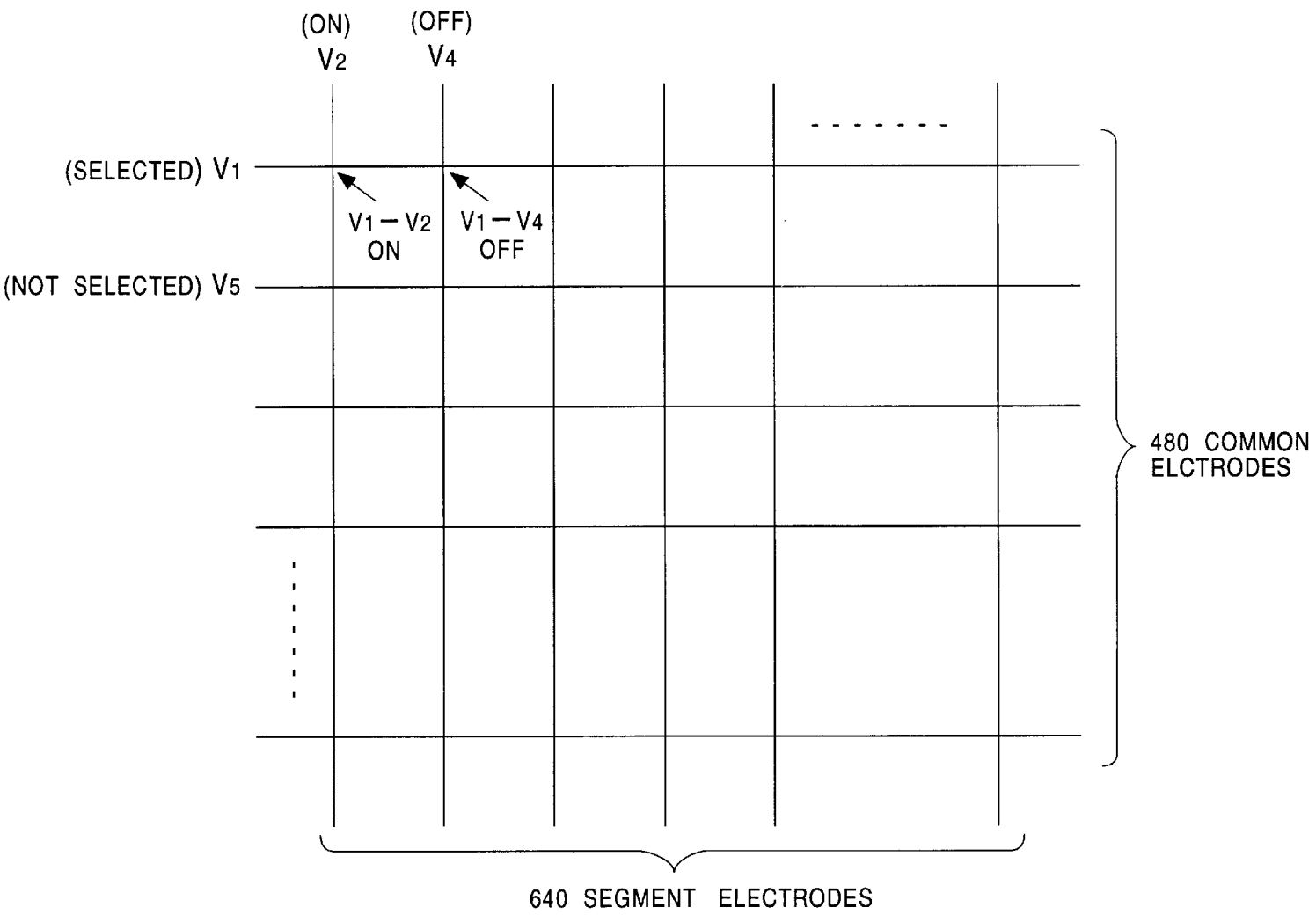
FIG. 10 illustrates an example in which the common electrodes and the segment electrodes are arranged to form the LCD panel shown in FIG. 8.
Figure 11:
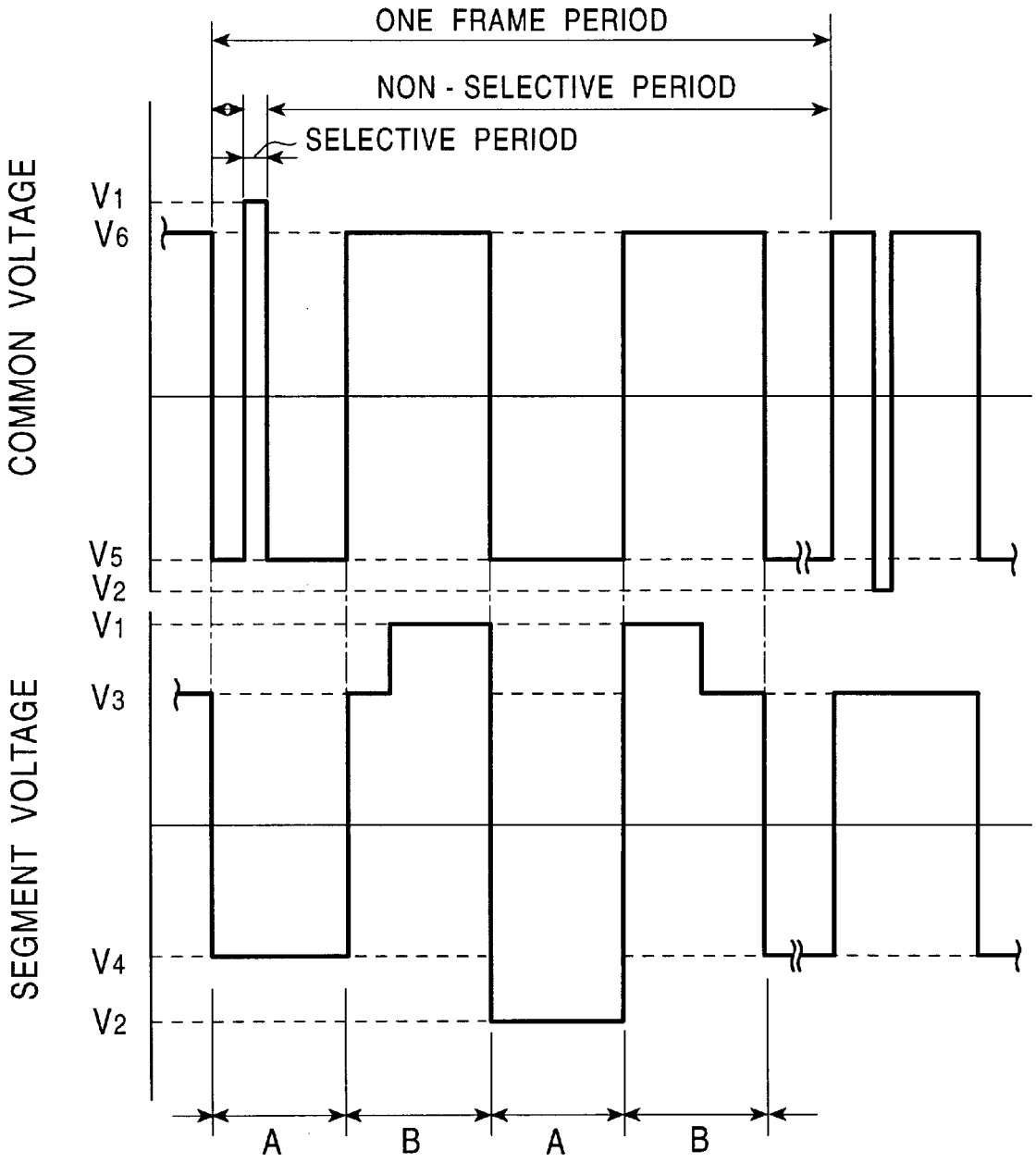
FIG. 11 is waveform diagrams respectively illustrating the common voltage and the segment voltage applied to a selected pixel during one frame period.
Figure 12:
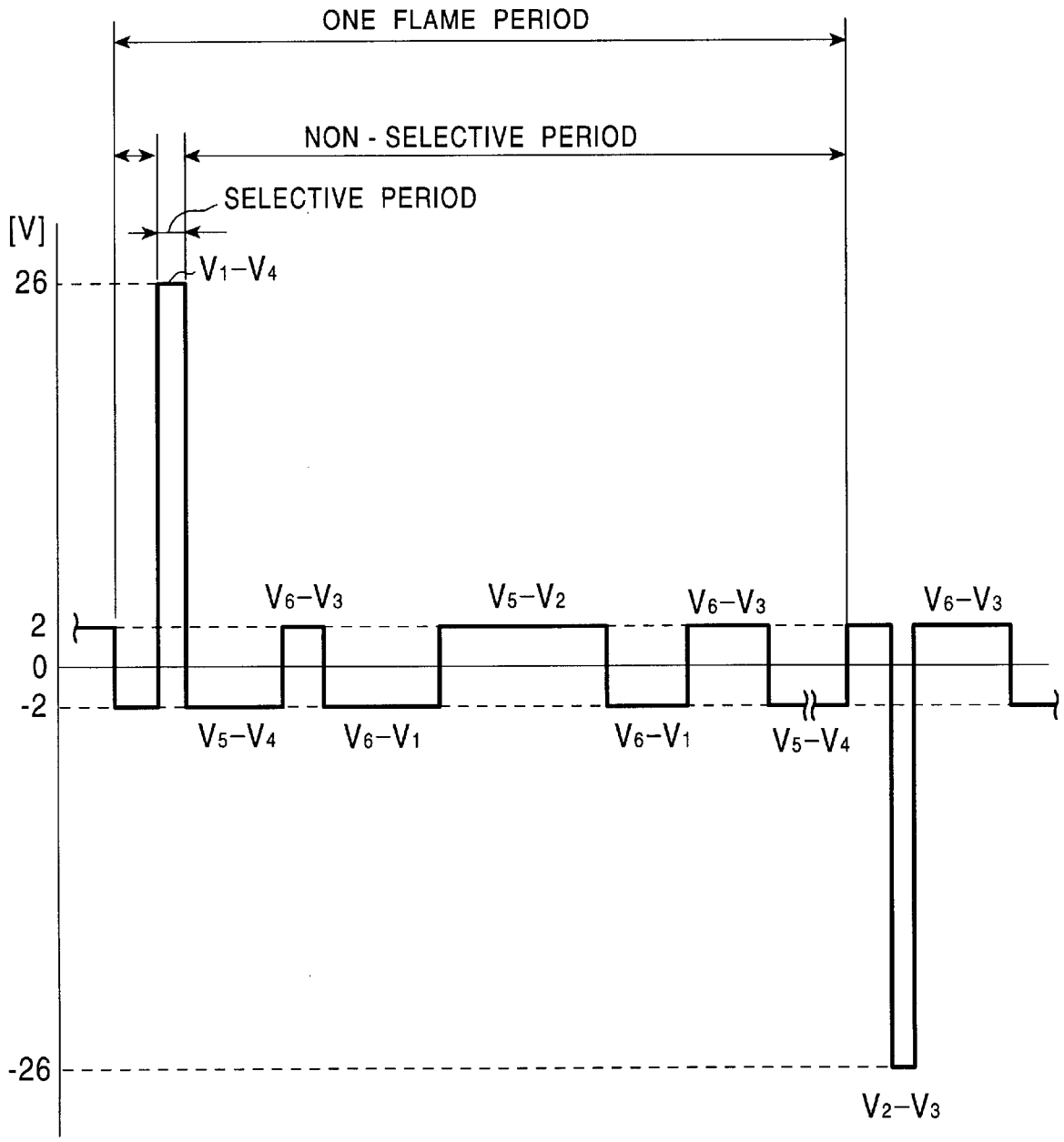
FIG. 12 is a waveform diagram illustrating a voltage applied to the liquid crystal layer of a selected pixel during one frame period.

FIG. 1 is a block diagram of a liquid crystal display apparatus according to an embodiment of the present invention. The elements corresponding to those shown in FIG. 8 are designated by like reference numerals, and an explanation thereof will thus be omitted.

A delay circuit 7 is newly provided in this liquid crystal display apparatus. The delay circuit 7 divides an AC signal (DF') generated by the AC signal circuit 2 to create a common AC signal (DF COM) and a segment AC signal (DF SEG) and delays one signal later than the other. In the conventional liquid crystal display apparatus illustrated in FIG. 8, the shared AC signal (DF') is input into the common drivers 5 and the segment drivers 6. In contrast, in this embodiment, divided AC signals that are switched at different timings are input into the common drivers 5 and the segment drivers 6, respectively.

The specific configurations of the foregoing delay circuit 7 will now be explained through illustration of first through fifth embodiments.

[First Embodiment]

Figure 2:
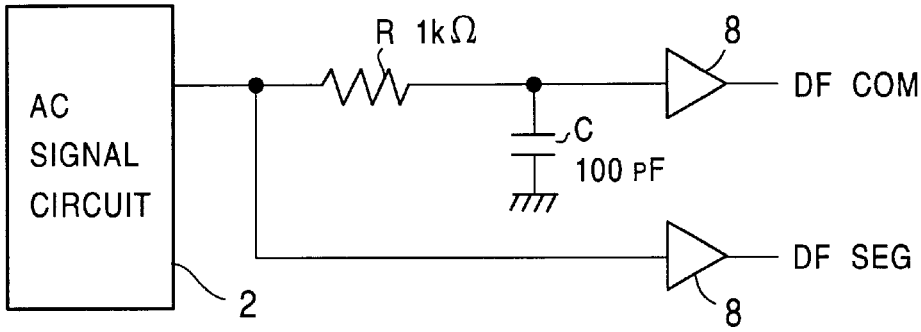
FIG. 2 is a circuit diagram illustrating the configuration of a first embodiment of the present invention.

A first embodiment of the present invention will now be described with reference to FIG. 2. Referring to the circuit diagram shown in FIG. 2, the resistance of a resistor R is, for example, 1 [kΩ], while the capacitance of a capacitor C is, for example, 100 [pF]. The resistor R and the capacitor C form an integrating circuit. Gates 8 are, for example, the types of Schmitt trigger gates.

In this circuit 7, the AC signal produced by the AC signal circuit 2 is branched into two signals, and one AC signal is delayed by the integrating circuit and the Schmitt trigger circuits 8. The delayed AC signal is then input as a common AC signal (DF COM) into the common drivers 5, while the other AC signal is input as a segment AC signal (DF SEG) into the segment drivers 6.

[Second Embodiment]

Figure 3:
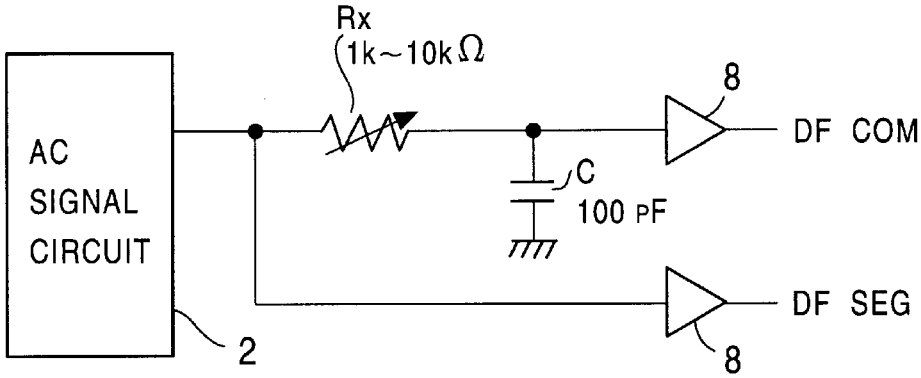
FIG. 3 is a circuit diagram illustrating the configuration of a second embodiment of the present invention.

A second embodiment of the present invention will now be described with reference to the circuit diagram of FIG. 3. The elements corresponding to those shown in FIG. 2 are designated by like reference numerals, and an explanation thereof will thus be omitted. In the delay circuit of the second embodiment, a variable resistor Rx is substituted for the resistor R used in the delay circuit of the first embodiment. The resistance of the variable resistor Rx is adjustable in a range, for example, from 1 to 10 [kΩ]. In this embodiment, the delay time of the common AC signal (DF COM) can be varied by adjusting the variable resistor Rx.

[Third Embodiment]

Figure 4:
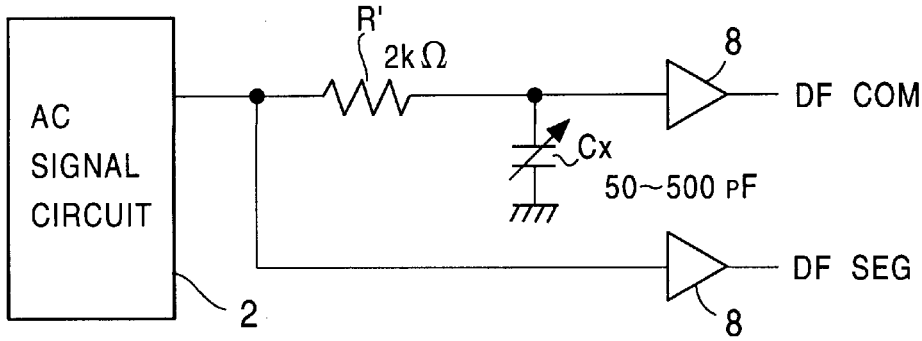
FIG. 4 is a circuit diagram illustrating the configuration of a third embodiment of the present invention.

A third embodiment of the present invention will now be explained while referring to the circuit diagram shown in FIG. 4. The elements corresponding to those shown in FIG. 2 are designated by like reference numerals, and an explanation thereof will thus be omitted. In the delay circuit of the third embodiment, a variable capacitor Cx is provided in place of the capacitor C. The capacitance of the variable capacitor Cx is adjustable in a range, for example, from 50 to 500 [pF]. In this embodiment, the delay time of the common AC signal (DF COM) can be changed by regulating the variable capacitor Cx.

[Fourth Embodiment]

Figure 5:
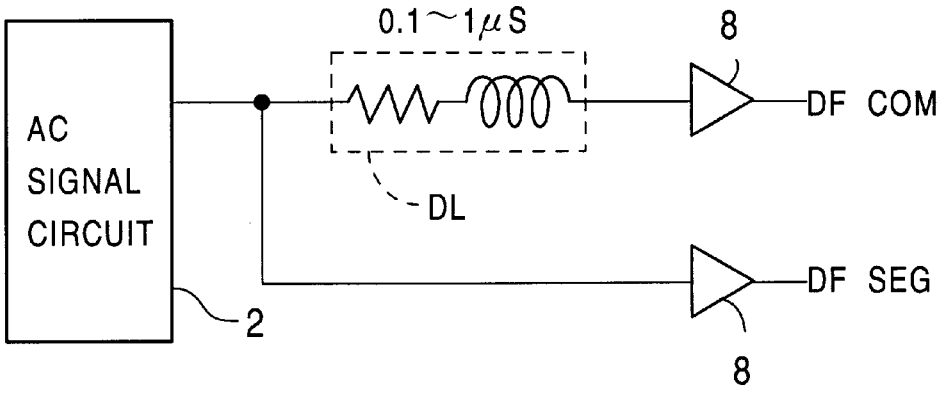
FIG. 5 is a circuit diagram illustrating the configuration of a fourth embodiment of the present invention.

A description will now be given of a fourth embodiment of the present invention with reference to the circuit diagram shown in FIG. 5. The elements corresponding to those shown in FIG. 2 are designated by like reference numerals, and an explanation thereof will thus be omitted. In the delay circuit of the fourth embodiment, a delay line DL is disposed instead of an integrating circuit formed of a resistor R and a capacitor C. In this embodiment, the delay time of the delay line DL ranges, for example, from 0.1 to 1 [μs].

In this circuit, an AC signal generated by the AC signal circuit 2 is branched into two signals, and one signal is delayed by the delay line DL. Then, the delayed AC signal is input as a common AC signal (DF COM) into the common drivers 5, while the other AC signal is input as a segment AC signal into the segment drivers 6.

[Fifth Embodiment]

Figure 6:
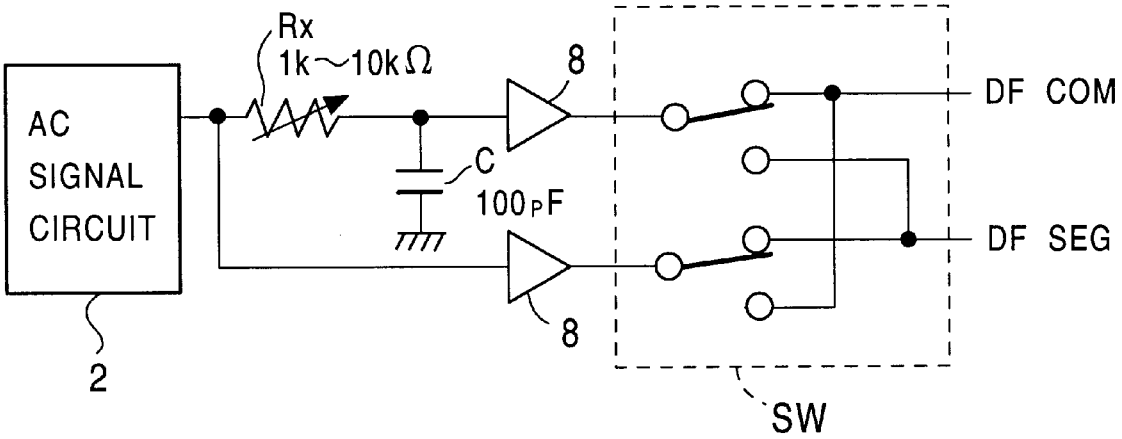
FIG. 6 is a circuit diagram illustrating the configuration of a fifth embodiment of the present invention.

A fifth embodiment of the present invention will now be explained while referring to the circuit diagram shown in FIG. 6. In this embodiment, the same delay circuit as the circuit shown in FIG. 3 is used. A switching unit SW consisting of two switches operable in cooperation with each other is further provided subsequent to the delay circuit. By changing the two switches to either side, the two different signals, i.e., the common AC signal (DF COM) and the segment AC signal (DF SEG), can be output from the common AC signal line and the segment AC signal line, respectively, from the two switches.

In the circuits illustrated in FIGS. 2 through 5, the signal to be delayed, i.e., the common AC signal, is predetermined. In contrast, in the circuit shown in FIG. 6, either of the signals can be selectively delayed.

The embodiments which have been discussed in detail while referring to the drawings are given by way of example only, and the present invention is not restricted to the foregoing specific embodiments. Various changes and modifications may be made in the invention without departing from the spirit and scope of the invention.

For instance, the circuit diagrams shown in FIGS. 2 through 6 are given by way of example only, and any circuit may be safely employed as long as it meets the requirements discussed in the Summary of the Invention. Moreover, in the circuits shown in FIGS. 2 through 5, the segment AC signal (DF SEG) may be delayed instead of the common AC signal (DF COM). Additionally, although in FIG. 6 the switch unit SW is added to the circuit shown in FIG. 3, it may be used in another type of circuit.

In accordance with the foregoing specific embodiments, an evaluation test was carried out as follows. After narrow black bars were displayed in a white background on the screen of the liquid crystal display apparatus, the delay time of the common AC signal (DF COM) was progressively increased in relation to the segment AC signal (DF SEG). Then, the appearance of white crosstalk on the screen was visually checked.

Figure 7A:
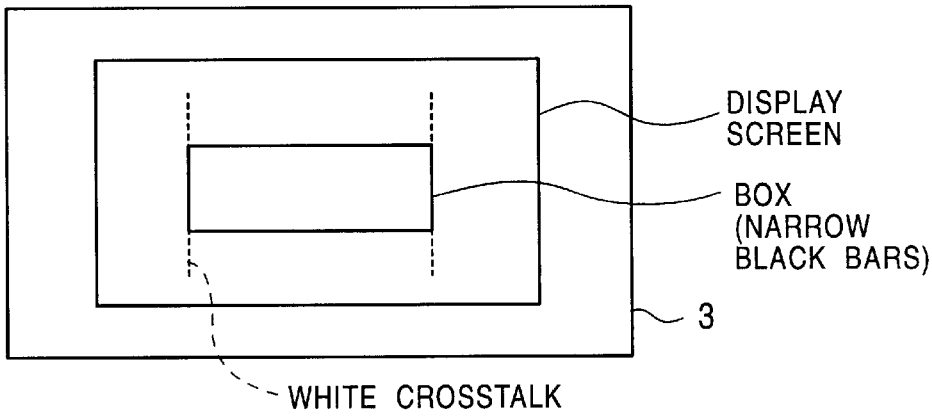
FIGS. 7A, 7B and 7C illustrate a display example of a liquid crystal display apparatus according to an embodiment of the present invention.
Figure 7B:
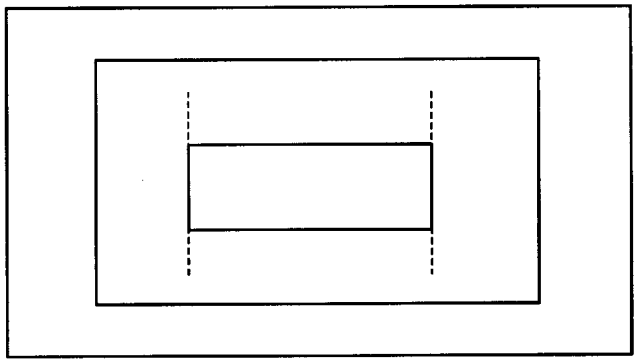
Figure 7C:
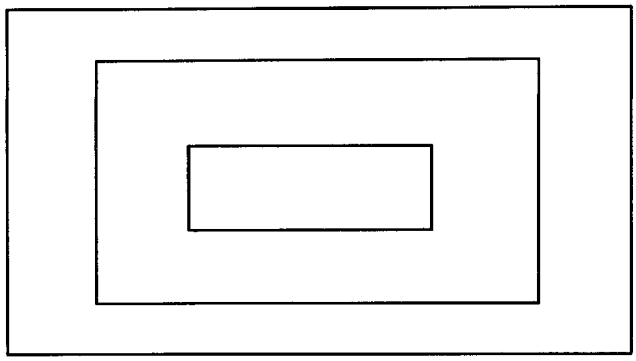

FIG. 7 illustrates display examples of the liquid crystal display apparatus according to the present invention. FIG. 7A illustrates the display state when the common AC signal (DF COM) was not delayed at all; FIG. 7B shows the display state when the common AC signal (DF COM) was delayed for 0.1 [μs]; and FIG. 7C illustrates the display state when the common AC signal (DF COM) was delayed for 0.3 [μs].

Although white crosstalk is indicated by broken lines in FIGS. 7A and 7B, this is only due to limitations imposed on the drawings of the present invention. In practice, however, crosstalk appears merely as faint lines with a brightness level higher than the white background on the lines extending from the black bars.

When the common AC signal (DF COM) was delayed for 0.1 [μs], a difference in the brightness between the white crosstalk and the white background obviously decreased, as shown in FIG. 7B, and improvements in the display state were observed. Further, when the delay time increased to 0.3 to 0.6 [μs], the brightness difference was almost negligible, as illustrated in FIG. 7C, thereby substantially eliminating crosstalk on the screen. If the delay time exceeded 1 [μs], black crosstalk then emerged, inverting the dark and bright levels of crosstalk.

As is seen from the foregoing description, the liquid crystal display apparatus of the present invention offers the following advantages.

It is possible to eliminate from the screen of the liquid crystal display apparatus white crosstalk, which is generated when narrow black bars are displayed in a white background, in other words, white bars having a brightness level higher than the white background, as appearing on the lines extending from the black bars. It is also possible to remove black crosstalk, which is produced when thick black bars are displayed in a white background, in other words, black bars having a brightness level slightly lower than the white background, as appearing on the lines extending from the black bars.

Moreover, while observing the screen, the user is able to adjust the resistance of a variable resistor or the capacitance of a capacitor in order to eliminate the crosstalk on the screen.

Further, either of the signals, i.e., the common AC signal or the segment AC signal, can be selectively delayed, thereby coping with either of the foregoing white crosstalk or black crosstalk.

What is claimed is:

1. Drive circuitry for use in a liquid crystal display apparatus, said drive circuitry comprising:

an alternating-current-signal delay circuit including delay means, said delay circuit dividing an alternating-current signal generated in said liquid crystal display apparatus into two signals so as to delay one of the divided signals by said delay means, wherein:

either of the delayed signal or the undelayed signal is used as a common alternating-current signal, and the other signal is used as a segment alternating-current signal;

said delay means comprises an integrating circuit containing a resistor and a capacitor, and binarizing means for binarizing an output signal of said integrating circuit with a predetermined threshold level; and said capacitor comprises a variable capacitor.

* * * * *